US009701504B2

(12) United States Patent
Van Gurp et al.

(10) Patent No.: US 9,701,504 B2
(45) Date of Patent: Jul. 11, 2017

(54) WINDING DEVICE

(71) Applicant: SAINT-GOBAIN ISOVER, Courbevoie (FR)

(72) Inventors: Rene Van Gurp, St Teteringen (NL); Lionel Martin, Valliguieres (FR); Fabrice Delesse, Piolenc (FR); Pierre Cognard, Beauvais (FR)

(73) Assignee: SAINT-GOBAIN ISOVER, Courbevoie (FR)

( * ) Notice: Subject to any disclaimer, the term of this patent is extended or adjusted under 35 U.S.C. 154(b) by 137 days.

(21) Appl. No.: 14/405,506

(22) PCT Filed: May 27, 2013

(86) PCT No.: PCT/FR2013/051162

§ 371 (c)(1),
(2) Date: Dec. 4, 2014

(87) PCT Pub. No.: WO2013/182777

PCT Pub. Date: Dec. 12, 2013

(65) Prior Publication Data

US 2015/0166287 A1 Jun. 18, 2015

(30) Foreign Application Priority Data

Jun. 4, 2012 (FR) ..... 12 55183

(51) Int. Cl.
*B65H 18/22* (2006.01)

(52) U.S. Cl.
CPC ... *B65H 18/22* (2013.01); *B65H 2301/51232* (2013.01); *B65H 2701/177* (2013.01)

(58) Field of Classification Search
CPC ..... B65H 18/22; B65H 2301/51232; B65H 2701/177
See application file for complete search history.

(56) References Cited

U.S. PATENT DOCUMENTS 4,583,697 A 4/1986 Bichot et al.
5,305,963 A * 4/1994 Harvey, III ..... B65B 63/024 100/40
6,109,560 A 8/2000 Siegel

FOREIGN PATENT DOCUMENTS

DE 296 04 901 U1 6/1996
EP 0 140 785 A1 5/1985
(Continued)

OTHER PUBLICATIONS

International Search Report issued Sep. 16, 2013, in PCT/FR13/051162 filed May 27, 2013.

*Primary Examiner* — Sang Kim
(74) *Attorney, Agent, or Firm* — Oblon, McClelland, Maier & Neustadt, L.L.P.

(57) ABSTRACT

A winding device for formation of fibrous rolls includes: a first conveyor and a second conveyor; a movable compression roller which delimits a winding area with guide surfaces of the conveyors; a movable pre-compression conveyor including an upstream roller, a downstream assembly with a curved downstream end, and a belt wound around the upstream roller and the downstream assembly. The belt is held under tension against the downstream assembly and forms, facing the guide surface of the first conveyor, a circulating pre-compression surface for pre-compression of a fibrous mat to be wound, the pre-compression surface being a pre-compression element closest to the winding area.

20 Claims, 6 Drawing Sheets

(56) References Cited

FOREIGN PATENT DOCUMENTS

| | | | |
|---|---|---|---|
| EP | 0 734 985 | A1 | 10/1996 |
| EP | 0 941 952 | A1 | 9/1999 |
| EP | 0 949 172 | A1 | 10/1999 |

* cited by examiner

WINDING DEVICE

The present invention relates to a winding device for the formation of compressed fibrous rolls from compressible flexible fibrous mats.

In order to reduce the size of flexible fibrous mats, it is known to wind them on themselves in the compressed state, which makes it possible to obtain rolls with a reduced diameter. In particular, it is conventional to wind around themselves fibrous mats based on inorganic fibers, in particular glass fibers or rock fibers, which are designed for thermal and/or acoustic insulation of buildings, vehicles or machines. These fibrous mats, which generally have a density of between 5 and 50 kg/m$^3$, are wound on themselves with high compression levels, such as to reduce the transport and storage costs.

The operation of winding a fibrous mat must be carried out under controlled conditions, in order not to exceed a maximum permissible compression level of the mat, beyond which there is a risk of deterioration of the fibers and of the potential bonding agent constituting the mat. Preferably, the winding operation is optimized such that the compression level is regular along the entire length of the mat, and is designed not to damage the fibers and the bonding agent. This therefore ensures both that the size of the fibrous mat in the wound state is minimized, and that, when it is unwound, the fibrous mat regains its thickness and its nominal insulating characteristics.

U.S. Pat. No. 6,109,560 A describes a winding device for winding fibrous mats, comprising a horizontal conveyor, a dorsal conveyor, and a compression roller which delimit a winding area between one another. In this device, a third conveyor is disposed above the horizontal conveyor, such as to converge with the latter toward the winding area. The third conveyor is designed to ensure pre-compression of the fibrous mat before it enters the winding area. In U.S. Pat. No. 6,109,560 A, the mat is compressed to the compression level required for the winding by a pre-compression plate which extends at the front of the third conveyor, and projects into the winding area. During a winding operation, the mat placed on the horizontal conveyor moves under the pre-compression plate. This results in a substantial friction force at the interface between the mat and the pre-compression plate, which is all the greater the higher the speed of movement of the mat. However, a friction force of this type can damage the mat, and in particular degrade its qualities of regaining thickness, and therefore its insulating qualities.

It is these disadvantages which the invention intends to eliminate more particularly, by proposing a winding device which permits winding of a fibrous mat with a high level of compression, while limiting the risks of damaging the mat, in particular for high speeds of movement of the mat.

For this purpose, the subject of the invention is a winding device for the formation of fibrous rolls from compressible fibrous mats, comprising:

- a first conveyor and a second conveyor with guide surfaces which form an acute angle between one another;
- a movable compression roller which is disposed in the acute angle between the guide surfaces, with the compression roller and the guide surfaces delimiting a winding area;
- a movable pre-compression conveyor, a face of which faces the guide surface of the first conveyor, and converges with the latter toward the winding area, the pre-compression conveyor comprising:
  - an upstream roller at its end which is furthest from the winding area;
  - a downstream assembly at its end which is closest to the winding area, the downstream assembly having a curved downstream end; and
  - a belt which is wound around the upstream roller and the downstream assembly, characterized in that, facing the guide surface of the first conveyor, the belt is held under tension against the downstream assembly and forms a circulating pre-compression surface for pre-compression of a fibrous mat to be wound, this pre-compression surface being the pre-compression element which is closest to the winding area.

Within the context of the invention, a pre-compression element means any element which, in association with the guide surface of the first conveyor, ensures compression of the mat before it enters the winding area.

By means of the invention, the required level of compression of the mat is obtained from a pressure force exerted on the mat by the pre-compression surface, which is the pre-compression element closest to the winding area. Yet, the pre-compression surface is a rolling element, since it is formed by the belt of the pre-compression conveyor which is held under tension and circulates against the downstream assembly. Consequently, in comparison with the case in which the pressure force is exerted on the mat by a sliding element, the friction at the interface between the mat and the pre-compression surface is greatly reduced, which makes it possible to maintain better the properties of the mat.

Advantageously, the pre-compression surface formed by the belt held under tension against the downstream assembly is a substantially flat surface which can exert along its entire length a homogenous pressure force on a fibrous mat received between the guide surface of the first conveyor and the pre-compression surface. Within the meaning of the invention, a substantially flat surface is a flat surface which is substantially without irregularities relative to a mean plane of the surface. By means of such a substantially flat pre-compression surface, variations of the compression level are avoided, and in particular alternations of compression and decompression of the mat, which would be liable to damage the structure of the mat. This contributes towards preserving the properties of the mat.

Advantageously, the downstream assembly of the pre-compression conveyor has a length, in normal projection on the guide surface of the first conveyor, of 30 mm or more, preferably 80 mm or more. Thus, the pre-compression force exerted on a fibrous mat before it enters the winding area is applied homogenously to an entire section of the mat along the downstream assembly, and not only on a reduced portion of the mat at the downstream end of the pre-compression conveyor. Consequently, in the downstream area of the pre-compression conveyor where the level of pre-compression applied to the mat is highest, the compression force on the mat is distributed over a larger surface area. This limits the risk of deterioration of the mat which could occur in the case in which a substantial compression force is applied on the mat suddenly and in a localized manner at the downstream end of the pre-compression conveyor.

According to an advantageous characteristic, the distance between the pre-compression conveyor and the guide surface of the first conveyor is minimal at the downstream end. In particular, at the downstream end, the distance between the pre-compression surface and the guide surface of the first conveyor is equal to a desired pre-compressed thickness of a fibrous mat entering the winding area.

According to another advantageous characteristic, when the winding device is in a winding start configuration, the downstream end is disposed between the compression roller and the guide surface of the first conveyor. This position of the downstream end makes it possible to limit as far as possible the re-inflation of the mat at the output from the pre-compression conveyor.

Preferably, the pre-compression surface is inclined at an angle of between 5° and 15°, preferably of 10° or less, relative to the guide surface of the first conveyor.

According to one aspect of the invention, the pre-compression conveyor comprises a cover which covers the belt at the end of the pre-compression conveyor which is closest to the winding area, while leaving the pre-compression surface uncovered. This cover makes it possible to avoid any risk of passage of the mat between the compression roller and the pre-compression conveyor.

Preferably, the curved downstream end of the pre-compression conveyor has a radius of curvature of between 5 mm and 40 mm, preferably between 5 mm and 20 mm. A small radius of curvature of the downstream end makes it possible to position the latter as close as possible to the winding area, between the compression roller and the guide surface of the first conveyor, such as to limit as far as possible the re-inflation of the mat at the output from the pre-compression conveyor, in particular at the start of winding.

Advantageously, during a winding operation, the speed of circulation of the belt of the pre-compression conveyor toward the winding area has a component parallel to the speed of circulation of the guide surface of the first conveyor, which component is of same direction and same modulus as the latter. An arrangement of this type reduces the friction at the interface between the mat and the pre-compression surface, and limits the shearing of the mat.

According to one aspect of the invention, the belt of the pre-compression conveyor circulates around the upstream roller and the downstream end, while being driven by the upstream roller.

According to one embodiment, the downstream assembly is a plate provided with a curved ridge ("knife edge") as a downstream end.

According to another embodiment, the downstream assembly comprises a downstream roller as a downstream end and an assembly of n additional rollers, where nl, which each have their axis parallel to the axis of the downstream roller, and are juxtaposed relative to one another and to the downstream roller in the interior of the belt, such that, facing the guide surface of the first conveyor, the belt, which is held under tension against the or each additional roller and the downstream roller which are juxtaposed, forms the circulating pre-compression surface. In comparison with the case in which a plate provided with a curved ridge ("knife edge") is used for the winding of the belt at the downstream end of the pre-compression conveyor, the presence of the downstream roller and the additional rollers makes it possible to reduce the wear of the belt, and therefore to increase its service life. In addition, since the downstream roller and the additional rollers form a series of rollers which are juxtaposed relative to one another and the belt of the pre-compression conveyor is held under tension and bears against this series of rollers, the pressure force exerted on the mat by the pre-compression surface is substantially regular along the surface. This contributes towards preserving the properties of the mat. In particular, if the rollers were separate, alternation of compression and decompression of the mat could be observed between the rollers, which would be liable to damage the structure of the mat.

Preferably, the downstream roller and the or each additional roller have a radius of between 5 mm and 40 mm, preferably between 5 mm and 20 mm.

According to one aspect of the invention, the pre-compression conveyor comprises:

- a single upstream roller at its end which is furthest from the winding area;
- a plurality of curved downstream ends at its end which is closest to the winding area, the curved downstream ends being positioned aligned with each other, with their central axes being coincident and parallel to the axis of the upstream roller; and
- a plurality of belts, each belt being wound around the upstream roller and one of the downstream ends.

As a variant, the single upstream roller can be replaced by a plurality of upstream rollers positioned aligned with each other, with their axes being coincident, each upstream roller corresponding to one of the downstream ends, and each belt being wound around an upstream roller and the corresponding downstream end.

A structure of the pre-compression conveyor with parallel belts as previously described makes it possible to limit the forces exerted on each of the downstream ends, and thus to reduce as far as possible the dimensions, in particular the radius of curvature, and therefore the size, of these downstream ends. Each downstream end with a reduced radius of curvature can then advance further into the winding area between the compression roller and the guide surface of the first conveyor, in particular at the start of winding. This contributes towards limiting the re-inflation of the mat at the output from the pre-compression conveyor. In addition, in the case of wear or breakage of one of the belts, the damaged belt can be changed independently from the others, which facilitates the maintenance of the winding device.

According to other advantageous characteristics, in the case in which the pre-compression conveyor has a structure with parallel belts as previously described:

- each downstream end is a downstream roller, and the pre-compression conveyor comprises, for each downstream roller and each corresponding belt, an assembly of n additional rollers, where nl, which each have their axis parallel to the axis of the downstream roller, and are juxtaposed relative to one another and to the downstream roller in the interior of the belt, such that, facing the guide surface of the first conveyor, the belt is held under tension against the or each additional roller and the downstream roller which are juxtaposed and forms a circulating pre-compression surface;
- the pre-compression conveyor comprises a plurality of covers, each cover covering one of the belts at the end of the pre-compression conveyor which is closest to the winding area, while leaving the pre-compression surface formed by this belt uncovered.

According to one aspect of the invention, the device comprises means for displacement in translation, during a winding operation, of the pre-compression conveyor away from the second conveyor parallel to the direction of circulation of the guide surface of the first conveyor. Advantageously, the speed of circulation of the belt of the pre-compression conveyor around the upstream roller and the downstream end is then adjusted, throughout the winding operation, such that the speed of circulation of the belt of the pre-compression conveyor toward the winding area retains its component parallel to the speed of circulation of the guide surface of the first conveyor with the same direction and the same modulus as the latter, despite the rearward movement of the pre-compression conveyor.

According to a characteristic which can be considered independently from the characteristics listed previously, and in particular independently from the form of the pre-compression elements of the winding device, the compression roller is fitted such as to rotate on a support, and the winding device comprises means for displacement, during a winding operation, of the support relative to the frame of the device, these means comprising two pairs of actuators which are fitted between the support and the frame of the device. The two actuators of one pair can be positioned laterally relative to the support, each acting at one lateral end of the support. In comparison with the case in which the actuation of the compression roller is ensured by a single arm provided with a counterweight, the putting into place of two pairs of actuators, for example hydraulic, electric or pneumatic actuators, which act on the compression roller, makes it possible to gain adjustment latitude for adjustment of the position of the compression roller during a winding operation. In practice, the use of four actuators makes it possible to obtain all the trajectories for the compression roller, while having a rigid device, thus guaranteeing strict control of the position of the mat.

The means for displacement of the support can be configured in order to position the compression roller, during a winding operation, on the bisectrix of the acute angle formed between the guide surfaces of the first and second conveyors. Thus, the relative arrangement of the different elements of the winding device has symmetry, which simplifies the adjustment and programming of the device. In practice, at the start of a winding operation, the compression roller is above the bisectrix, in order to permit the formation of a fibrous core, i.e. a first turn of the fibrous roll, and it then "catches up with" the bisectrix during the winding operation.

According to a characteristic which can be considered independently from the characteristics previously listed, and in particular independently from the form of the pre-compression elements of the winding device, the winding device comprises at least two compression rollers with different diameters, which are fitted such as to rotate on the same support, with their axes parallel to one another, the support being able to pivot around an axis parallel to the axes of the compression rollers such as to permit the selection of one of the compression rollers for an operation of winding of a fibrous mat.

The characteristics and advantages of the invention will become apparent in the following description of several embodiments of a winding device according to the invention, provided purely by way of example, and with reference to the attached drawings in which.

Figure 1:
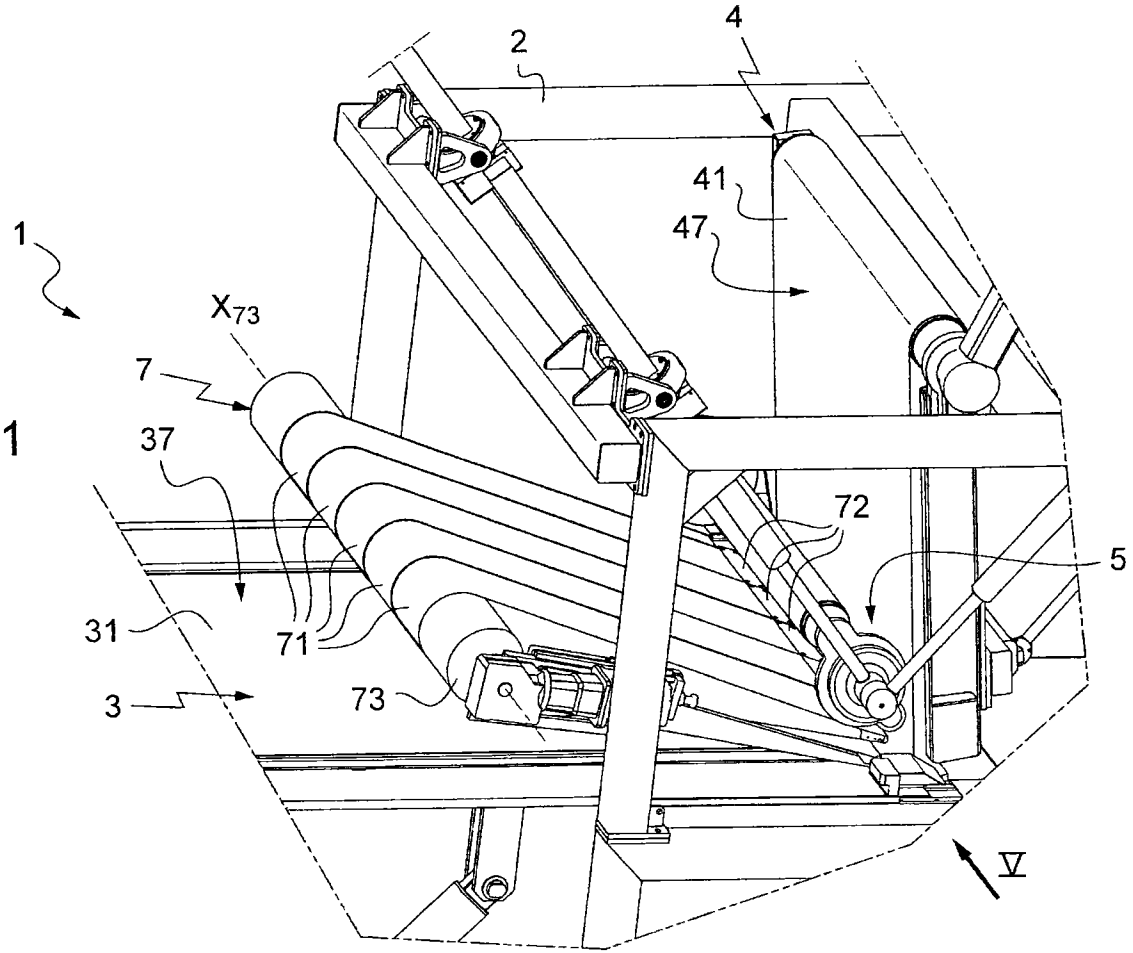
FIG. 1 is a partial perspective view of a winding device according to a first embodiment of the invention, the winding device being in a winding start configuration.
Figure 2:
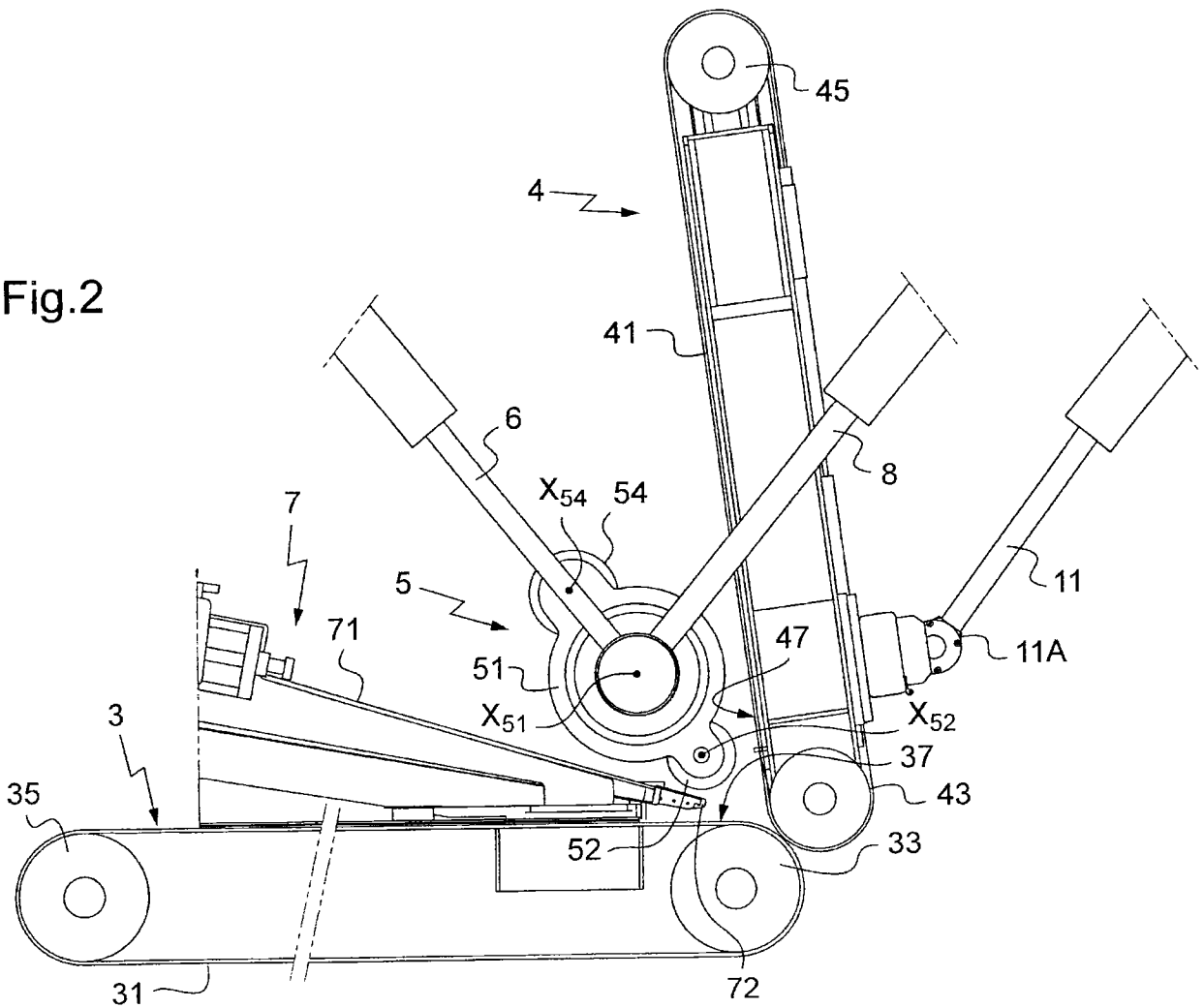
FIG. 2 is a partial lateral view of the device of FIG. 1.

For the sake of clarity, certain elements of the winding device have been represented schematically in FIGS. 1 to 8.

The winding device 1 represented in the figures is designed for winding of compressible flexible fibrous mats, in particular fibrous mats with insulating properties made from inorganic fibers such as glass fibers or rock fibers. The device 1 comprises a frame 2 which supports a horizontal conveyor 3. The horizontal conveyor 3 comprises an endless belt 31 which is wound around two rollers 33 and 35 with horizontal parallel axes. 37 indicates the upper surface of the horizontal conveyor 3, which is a guide surface designed to receive and guide a fibrous mat 9 in the direction of the arrow $F_1$ in FIG. 3.

The device 1 also comprises a dorsal conveyor 4 comprising an endless belt 41 which is wound around two rollers 43 and 45 with horizontal parallel axes. 47 indicates the surface of the dorsal conveyor 4 which faces the surface 37 of the horizontal conveyor. The surface 47 is a guide surface which is designed to receive and guide a fibrous mat 9 in the direction of the arrow $F_2$ in FIG. 3. The dorsal conveyor 4 is fitted such as to pivot on a first end 11A of a hydraulic actuator 11, the second end of which is articulated on the frame 2. For a winding operation, the dorsal conveyor 4 is positioned relative to the horizontal conveyor 3 such that the guide surfaces 37 and 47 form between them an acute angle $\alpha$ of between 60° and 90°, preferably approximately 75°. In a conventional manner, the dorsal conveyor 4 can be raised away from the horizontal conveyor 3 under the action of the actuator 11, in order to permit the discharge of a fibrous roll at the end of a winding operation.

The device 1 additionally comprises a compression assembly 5 comprising two compression rollers 52 and 54 which are fitted on the same support 51. The rollers 52 and 54 have different diameters, respectively a smaller diameter for the roller 52, for example approximately 125 mm, and a larger diameter for the roller 54, for example approximately 190 mm. The rollers 52 and 54 are fitted such as to rotate on the support 51 with their axes $X_{52}$ and $X_{54}$ horizontal and parallel, perpendicular to the direction $F_1$ of advance of the mat. In addition, the support 51 is designed to pivot around an axis $X_{51}$ parallel to the axes $X_{52}$ and $X_{54}$ of the two compression rollers, such as to permit the selection of one of the compression rollers 52, 54 for an operation of winding of a fibrous mat. In the figures, it is the compression roller 52 which has been selected to be active during the winding operation. During a winding operation, the compression roller selected is rotated around its axis of rotation $X_{52}$ or $X_{54}$ in the direction shown by the arrow $F_3$ in FIG. 3. As can be seen clearly in FIGS. 3 and 4, the active compression roller and the guide surfaces 37, 47 of the conveyors 3 and 4 delimit between one another a winding area 10 in which the fibrous roll is formed.

In practice, the two compression rollers 52 and 54 fitted on the same support 51 provide the possibility of selecting the compression roller which is most suitable according to the characteristics of the fibrous mat to be wound, in particular in order to maintain the quality of the mat at the start of winding. Indeed, at the start of a winding operation, the mat can be bent and compressed locally in an uncontrolled manner in the winding area 10, which can damage the mat or its surfacing and give rise to variations of recovery of thickness. The part of the mat affected is all the shorter, the smaller the diameter of the compression roller. However, the smaller the diameter of the compression roller, the greater the risk of splitting the front section of the mat when it is turned over in the stage of formation of the core. For a thick mat, the length of mat which forms the core is small, such that use of the compression roller with a larger diameter is acceptable. On the other hand, for a thinner mat, it is preferable to use the compression roller with a smaller diameter.

The support 51 for the compression rollers is connected to the frame 2 of the device by means of two pairs of hydraulic actuators 6, 8 which are configured to displace the support 51 and the compression rollers which are integral with it, during a winding operation. Thus, the position of the compression roller 52 or 54 which is active during the winding operation is adjustable, and the compression roller can be spaced from the guide surface 37 of the horizontal conveyor 3 as the diameter of the fibrous roll increases as a result of winding of the mat. As can be seen in FIG. 1, each lateral end of the support 51 is connected to an actuator 6 and to an actuator 8. The presence of two pairs of actuators 6, 8 acting on the lateral ends of the support 51 makes it possible to obtain any trajectory for the active compression roller, while having a rigid device. In particular, the four actuators 6, 8 can be configured in order to position the compression roller 52 or 54 which is active during the winding operation on the bisectrix of the angle $\alpha$ formed between the guide surface 37 of the horizontal conveyor 3 and the guide surface 47 of the dorsal conveyor 4.

Figure 5:
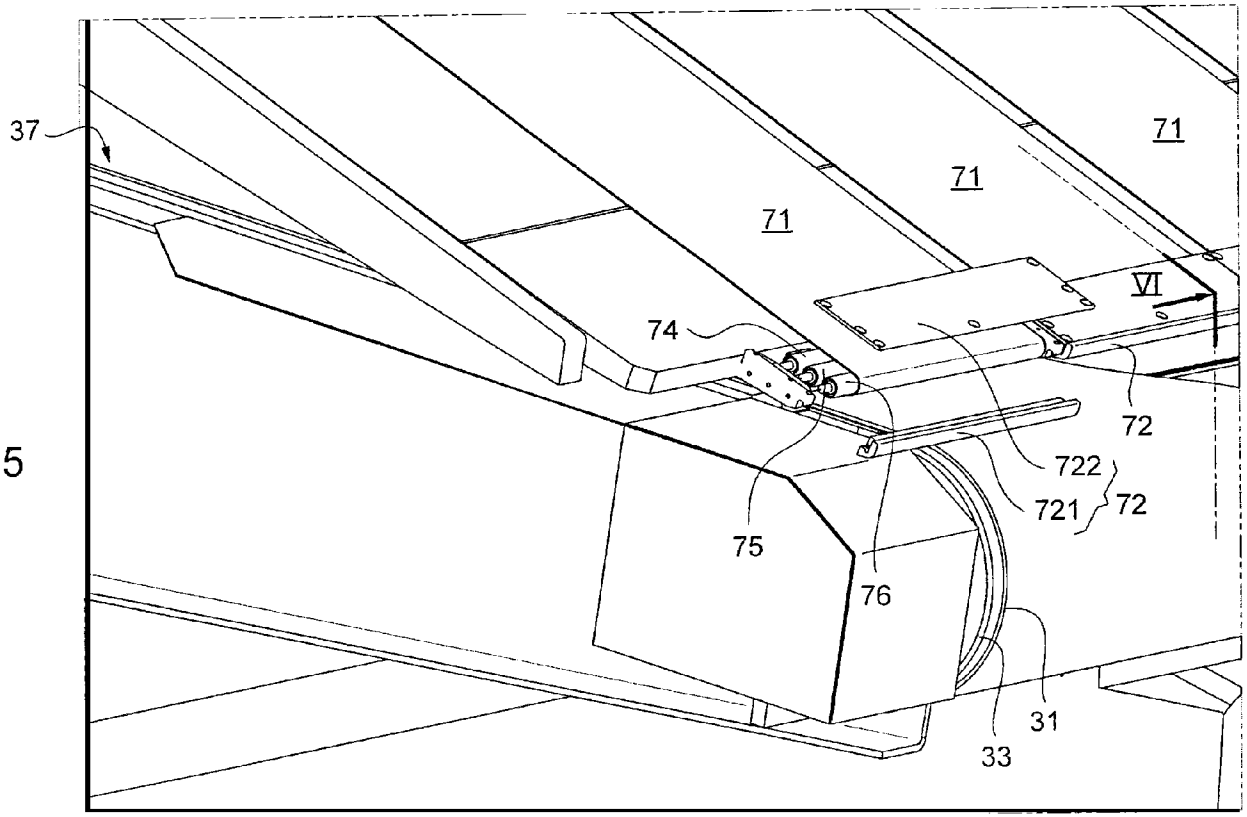
FIG. 5 is a perspective view according to the arrow V of FIG. 1.

The device 1 also comprises a third conveyor 7, known as the pre-compression conveyor, which is disposed above the horizontal conveyor 3, such that its face 77, which is positioned facing the guide surface 37, converges with the latter toward the winding area 10. The pre-compression conveyor 7 is designed to ensure pre-compression of the fibrous mat to a required compression level before the mat enters the winding area 10. As shown in FIGS. 1 and 5, the pre-compression conveyor 7 comprises a plurality of endless belts 71 which are parallel to one another and are driven in the direction of the arrow $F_4$ in FIG. 3. At its end which is furthest from the winding area 10, the pre-compression conveyor 7 comprises a single upstream roller 73 around which all the belts 71 are wound. The pre-compression conveyor 7 also comprises a body 70 accommodated in the interior of the belts 71, which is in the form of a "V" converging toward the winding area 10.

In the first embodiment represented in FIGS. 1 to 6, the pre-compression conveyor 7 comprises, at its end which is closest to the winding area 10, a plurality of downstream rollers 76 which are positioned aligned with each other, with their axes $X_{76}$ being coincident and parallel to the axis of the upstream roller $X_{73}$ which is horizontal. Each downstream roller 76 is used for winding of one of the belts 71.

As can be seen clearly in FIGS. 3 to 6, the pre-compression conveyor 7 comprises, for each downstream roller 76 and each corresponding belt 71, two additional rollers 74 and 75, which each have their axis $X_{74}$ or $X_{75}$ parallel to the axis $X_{76}$ of the downstream roller, and are disposed in the interior of the belt 71. In the interior of the belt 71, the first additional roller 74 is juxtaposed relative to the second additional roller 75, which itself is juxtaposed relative to the downstream roller 76. Thus, facing the guide surface 37 of the horizontal conveyor 3, the belt 71, which is held under tension and bears against the downstream assembly formed by the additional rollers 74 and 75 and the downstream roller 76 which are juxtaposed, defines a circulating pre-compression surface 79. The pre-compression conveyor 7 comprises means for tightening each belt 71, not represented in the figures, which are disposed on the side 78 of the pre-compression conveyor opposite from the horizontal conveyor 3.

Figure 3:
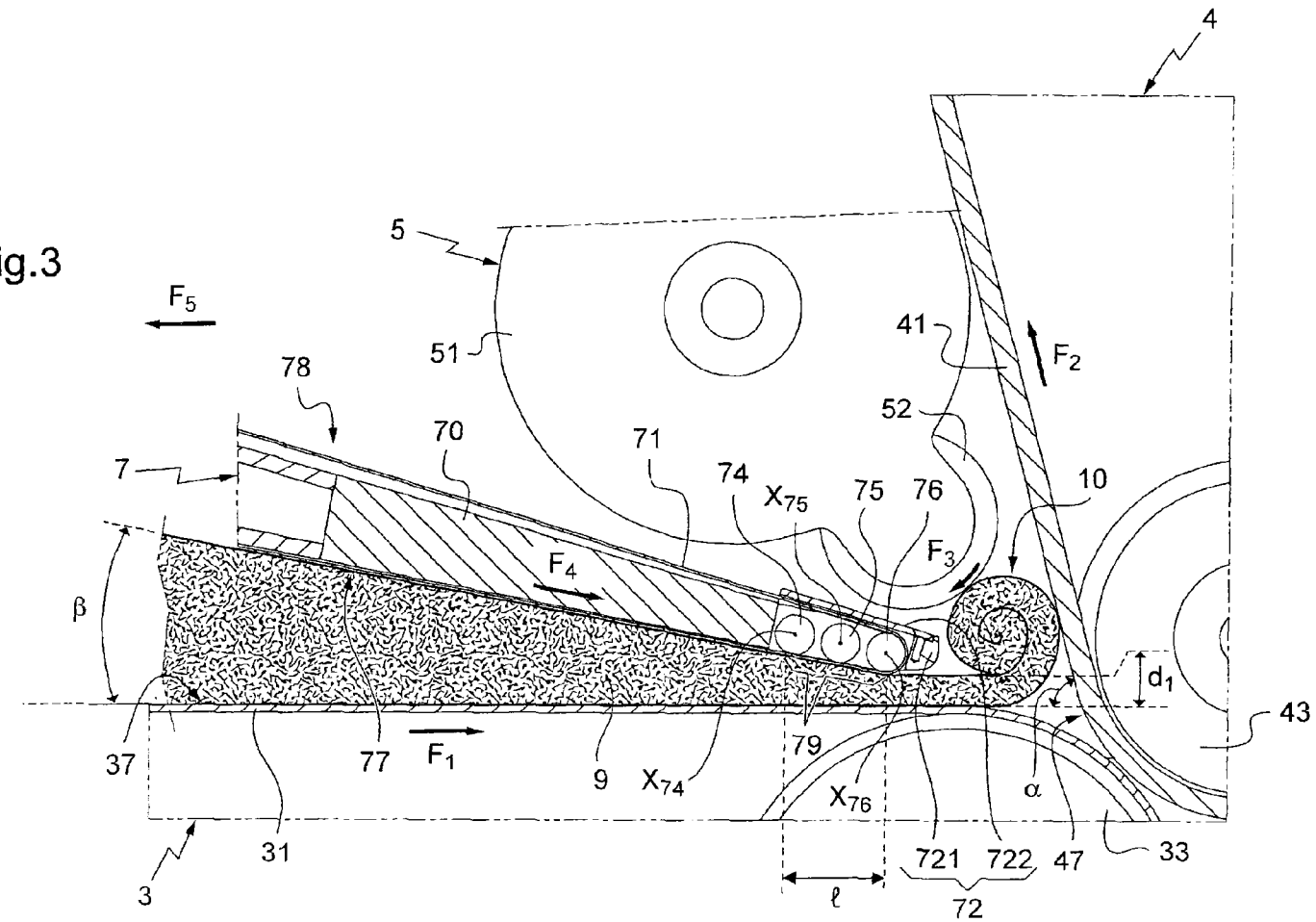
FIG. 3 is a cross-section on an enlarged scale of the winding area of the device of FIG. 1.
Figure 4:
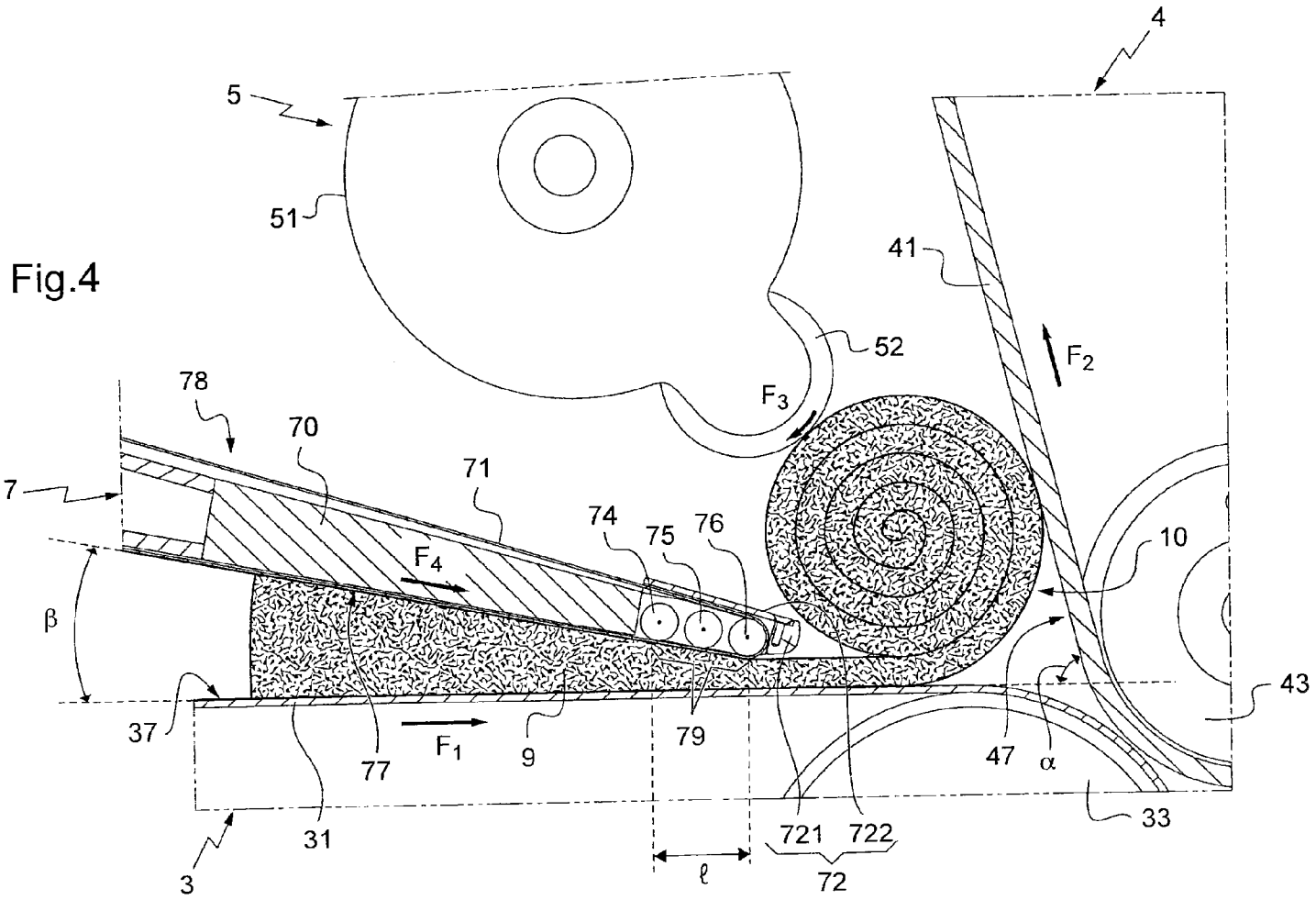
FIG. 4 is a cross-section similar to FIG. 3, the winding device being in a further winding configuration close to the end of winding.

Advantageously, the structure of the pre-compression conveyor 7 comprising a plurality of parallel belts 71 makes it possible to limit the forces exerted on each of the downstream rollers 76, and thus to reduce as far as possible the diameter of these rollers 76. In this embodiment, each downstream roller 76 has a radius of 15 mm, and the additional rollers 74 and 75 are also selected with a radius of 15 mm. More generally, the invention makes it possible to use downstream and additional rollers with radii of between 5 mm and 40 mm, preferably between 5 mm and 20 mm. As shown in FIG. 3, each downstream roller 76 is disposed, in the start of winding configuration, between the active compression roller 52 and the guide surface 37 of the horizontal conveyor 3. This arrangement is made possible by means of the restricted diameter of each downstream roller 76.

The pre-compression surface 79 formed by the belt 71 which is held under tension against the rollers 74, 75 and 76 is a homogenous surface with a length l of approximately 90 mm in normal projection on the guide surface 37 of the horizontal conveyor 3. The pre-compression surface 79 can thus exert a substantially homogenous pressure force on a section of fibrous mat with a length of approximately 90 mm, before the mat enters the winding area 10.

Figure 6:
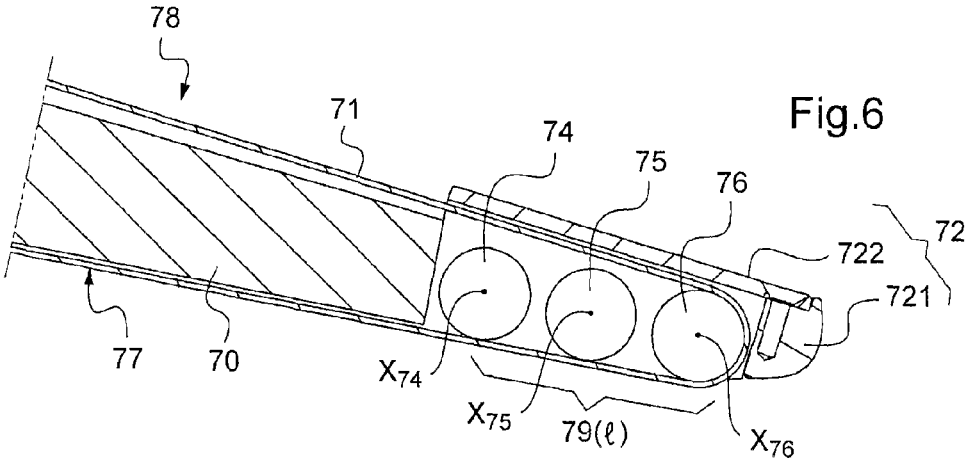
FIG. 6 is a cross-section on an enlarged scale according to the plane VI of FIG. 5.

In order to prevent any risk of a fibrous mat getting caught in the intermediate space defined between the active compression roller 52 and the belts 71, the pre-compression conveyor 7 comprises a plurality of covers 72, wherein each cover 72 covers one of the belts 71 at the end of the pre-compression conveyor which is closest to the winding area 10, while leaving the pre-compression surface 79 formed by this belt 71 uncovered. As shown in FIG. 6, each cover 72 extends, on the side 78 of the pre-compression conveyor opposite from the horizontal conveyor 3, facing the corresponding downstream roller 76, without extending beyond the additional rollers 74 and 75.

The angle of inclination $\beta$ of the pre-compression surface 79 relative to the guide surface 37 is approximately 10°. More generally, the angle is advantageously between 5° and 15°, preferably equal to or less than 10°. The distance $d_1$ between the pre-compression conveyor 7 and the guide surface 37 of the horizontal conveyor 3 is selected to be minimal at each downstream roller 76. Thus, the required level of compression of the mat which enters the winding area is reached at least at the downstream roller of the pre-compression conveyor. The distance $d_1$ between the pre-compression surface 79 at the downstream roller 76 and the guide surface 37 of the first conveyor is adjustable, and is equal to the desired pre-compressed thickness of a fibrous mat entering the winding area. The position, at the start of winding, of the downstream roller 76 between the compression roller 52 and the guide surface 37 of the first conveyor makes it possible to limit as far as possible the re-inflation of the mat at the output from the pre-compression conveyor 7.

Figure 7:
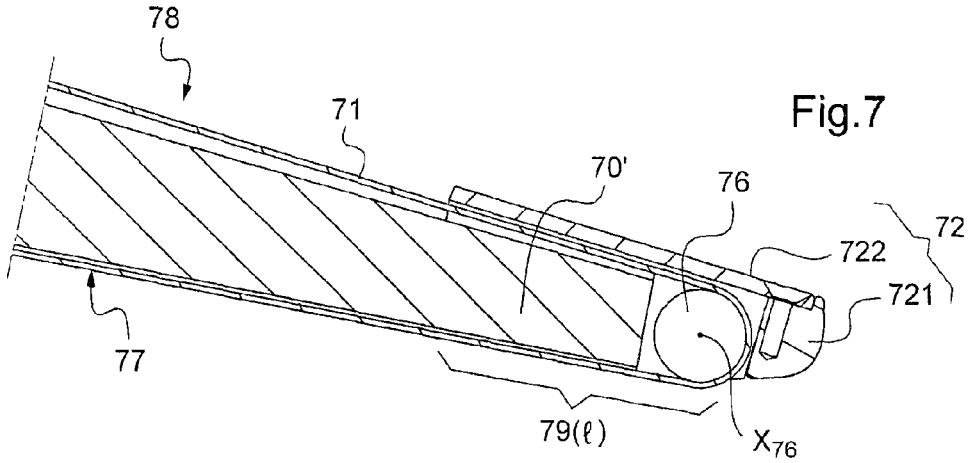
FIG. 7 is a cross-section similar to FIG. 6, for a winding device according to a second embodiment of the invention.
Figure 8:
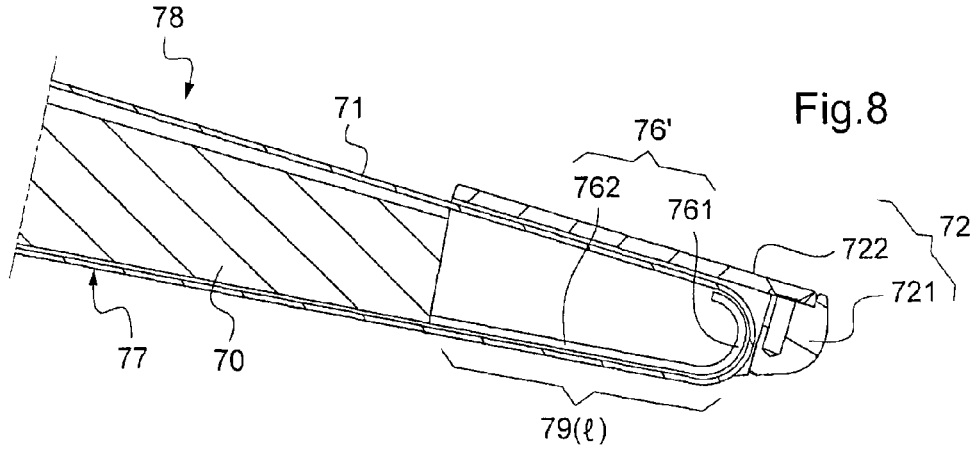
FIG. 8 is a cross-section similar to FIG. 6 for a winding device according to a third embodiment of the invention.

In the second and third embodiments represented in FIGS. 7 and 8, each winding device differs from the device in the first embodiment only in the structure of the downstream assembly of its pre-compression conveyor 7.

In particular, in FIG. 7, the pre-compression conveyor 7 has no additional rollers, and the body 70' extends until it is juxtaposed with the series of downstream rollers 76. Thus, in the second embodiment, for each downstream roller 76 and each corresponding belt 71, the circulating pre-compression surface 79 is formed, facing the guide surface 37 of the horizontal conveyor 3, by the belt 71 which is held under tension and bears against the downstream assembly formed by the downstream end of the body 70' and the downstream roller 76 which is juxtaposed in relation to it.

In FIG. 8, the pre-compression conveyor 7 does not have either additional rollers or downstream rollers. In this third embodiment, the downstream end around which each of the belts 71 is wound is formed by a curved ridge 761 of a thin plate 76' ("knife edge") which extends from the downstream end of the body 70 toward the winding area 10. For each belt 71, the circulating pre-compression surface 79 is then formed, facing the guide surface 37 of the horizontal conveyor 3, by the belt 71 which is held under tension and bears against the downstream assembly formed by the flat part 762 and the curved ridge 761 of the plate 76'. In this embodiment, each curved ridge 761, centered on a central axis $X_{761}$, has a radius of curvature of approximately 10 mm. More generally, the radius of curvature is preferably between 5 mm and 40 mm.

For the three embodiments previously described, the winding device 1 functions as follows.

A fibrous mat 9, positioned on the horizontal conveyor 3, is driven jointly by the horizontal conveyor 3 and by the pre-compression conveyor 7 toward the winding area 10. As shown in FIG. 3, the mat 9 is compressed between the guide surface 37 of the horizontal conveyor 3 and the face 77 of the pre-compression conveyor 7. In order to limit the shearing of the mat 9, the speed of circulation of the belt 71 of the pre-compression conveyor 7 relative to the frame 2 is advantageously adjusted such that its component directed parallel to the direction $F_1$ of circulation of the guide surface 37 of the horizontal conveyor 3, i.e. its horizontal component in the example represented, has the same direction and the same modulus as the speed of circulation of the guide surface 37 relative to the frame.

In the winding area 10, by means of the combined driving of the horizontal conveyor 3, the dorsal conveyor 4 and the compression roller 52, a fibrous core is formed, which corresponds to a first turn of a fibrous roll. During the winding, the contact pressure exerted by the compression roller 52 is controlled by means of the four actuators 6 and 8, such that the fibrous roll which is being formed remains substantially cylindrical.

As the winding is continued, and the diameter of the fibrous roll increases, the pre-compression conveyor 7 is displaced in the direction of the arrow $F_5$ in FIG. 3. The horizontal component of the speed of circulation of the belt 71 increases in accordance with the speed of reverse travel of the pre-compression conveyor 7, so as to prevent shearing of the mat 9.

As is apparent from the preceding description, a winding device according to the invention makes it possible to limit the friction exerted on a fibrous mat when it is being wound, and thus to limit the risks of damaging the mat, even for high speeds of movement of the mat. In addition, as a result of the reduced dimensions of the downstream end of the pre-compression conveyor, a winding device according to the invention has improved compactness, while maintaining a high level of compression of the fibrous mat.

The invention is not limited to the examples described and represented.

In particular, within the context of the invention, the pre-compression conveyor can comprise a single belt 71 and a single downstream end 76, 761. In the case when it comprises a plurality of belts 71 and downstream ends 76, 761, the pre-compression conveyor can also comprise a plurality of upstream rollers, instead of a single upstream roller 73, each upstream roller corresponding to one of the downstream ends and each belt being wound around an upstream roller and the corresponding downstream end. In addition, in the first embodiment, the number of the additional rollers 74, 75 can be other than two, and in particular the pre-compression conveyor can comprise a number $n \geq 1$ of additional rollers, n being preferably equal to 1, 2 or 3.

Putting into place two pairs of actuators fitted between the support and the frame of the device in order to displace the compression roller support 51 can also take place within the context of a winding device with pre-compression means of any type, which in particular are other than the conveyor 7 with a circulating pre-compression surface as previously described.

Similarly, putting into place two pairs of actuators can take place in order to displace a conventional compression roller support which supports a single compression roller instead of two compression rollers which can be selected as previously described.

The use of a compression roller support which supports at least two compression rollers which can be selected can also be envisaged for a winding device with pre-compression means of any type, which in particular are other than the conveyor 7 with a circulating pre-compression surface, and means for displacement of the compression roller support of any type, which in particular are other than the two pairs of actuators 6, 8.

The invention claimed is:

1. A winding device for formation of fibrous rolls from compressible fibrous mats, comprising:

a first conveyor and a second conveyor including guide surfaces that form an acute angle between one another;

a movable compression roller disposed in the acute angle between the guide surfaces, with the compression roller and the guide surfaces delimiting a winding area;

a movable pre-compression conveyor, a face of which faces the guide surface of the first conveyor, and converges with the first conveyor toward the winding area, the pre-compression conveyor including a first end that is furthest from the winding area and a second end that is closest to the winding area, the pre-compression conveyor comprising:

an upstream roller at the first end;

a downstream assembly at the second end, the downstream assembly having a curved downstream end; and a belt wound around the upstream roller and the downstream assembly;

wherein, facing the guide surface of the first conveyor, the belt, which is held under tension against the downstream assembly, forms a circulating pre-compression surface for pre-compression of a fibrous mat to be wound, and wherein the circulating pre-compression surface is a pre-compression element that contacts the fibrous mat closest to the winding area.

2. The winding device as claimed in claim 1, wherein the pre-compression surface formed by the belt held under tension against the downstream assembly is a substantially flat surface that can exert a homogenous pressure force on the fibrous mat to be wound.

3. The winding device as claimed in claim 1, wherein the downstream assembly has a length, in normal projection on the guide surface of the first conveyor, of 30 mm or more, or 80 mm or more.

4. The winding device as claimed in claim 1, wherein the distance between the pre-compression conveyor and the guide surface of the first conveyor is minimal at the downstream end.

5. The winding device as claimed in claim 1, wherein, when the winding device is in a winding start configuration, the downstream end is disposed between the compression roller and the guide surface of the first conveyor.

6. The winding device as claimed in claim 1, wherein the pre-compression conveyor comprises a cover which covers the belt at an end of the pre-compression conveyor that is closest to the winding area, while leaving the pre-compression surface uncovered.

7. The winding device as claimed in claim 1, wherein the downstream end has a radius of curvature of between 5 mm and 40 mm, or between 5 mm and 20 mm.

8. The winding device as claimed in claim 1, wherein, during a winding operation, a speed of the belt of the pre-compression conveyor toward the winding area has a component parallel to a speed of the guide surface of the first conveyor, the component of speed of the pre-compression conveyor having a same direction and a same modulus as the speed of the guide surface of the first conveyor.

9. The winding device as claimed in claim 1, wherein the belt of the pre-compression conveyor circulates around the upstream roller and the downstream end, while being driven by the upstream roller.

10. The winding device as claimed in claim 1, wherein the downstream assembly comprises a plate including a curved ridge as a downstream end.

11. The winding device as claimed in claim 1, wherein the downstream assembly comprises a roller as a downstream end and an assembly of n additional rollers, where n>1, each of the n additional rollers has their axis parallel to the axis of the downstream roller, and are juxtaposed relative to one another and to the downstream roller in an interior of the belt, such that, facing the guide surface of the first conveyor, the belt, which is held under tension against each n additional rollers and the downstream roller which are juxtaposed, forms the circulating pre-compression surface.

12. The winding device as claimed in claim 11, wherein the or each downstream roller and the or each additional roller has a radius of between 5 mm and 40 mm, or between 5 mm and 20 mm.

13. The winding device as claimed in claim 1, wherein the pre-compression conveyor comprises:

a plurality of curved downstream ends at its end which is closest to the winding area, the curved downstream ends being positioned aligned with each other, with their central axes parallel to the axis of the upstream roller; and a plurality of belts, each belt being wound around the upstream roller and one of the downstream ends.

14. The winding device as claimed in claim 13, wherein the upstream roller is comprised of a plurality of upstream rollers positioned aligned with each other with their axes being coincident, each upstream roller corresponding to one of the downstream ends, and each belt being wound around an upstream roller and the corresponding downstream end.

15. The winding device as claimed in claim 13, wherein each downstream end is a roller, and the pre-compression conveyor comprises, for each downstream roller and each corresponding belt, an assembly of n additional rollers, wherein n>1, which each have their axis parallel to the axis of the downstream roller, and are juxtaposed relative to one another and to the downstream roller in an interior of the belt, such that, facing the guide surface of the first conveyor, the belt, which is held under tension against the or each additional roller and the downstream roller which are juxtaposed, forms a circulating pre-compression surface.

16. The winding device as claimed in claim 13, wherein the pre-compression conveyor comprises a plurality of covers, each cover covering one of the belts at the end of the pre-compression conveyor which is closest to the winding area, while leaving the pre-compression surface formed by this belt not covered by the plurality of covers.

17. The winding device as claimed in claim 1, further comprising means for displacement in translation, during a winding operation, of the pre-compression conveyor away from the second conveyor parallel to a direction of circulation of the guide surface of the first conveyor.

18. The winding device as claimed in claim 1, wherein the compression roller is fitted to rotate on a support, and the device comprises an apparatus for displacement, during a winding operation, of the support relative to the frame of the device, the apparatus for displacement comprising two pairs of actuators that are fitted between the support and the frame.

19. The winding device as claimed in claim 18, wherein the apparatus for displacement of the support is configured to position the compression roller, during a winding operation, on the bisectrix of the acute angle formed between the guide surfaces of the first and second conveyors.

20. The winding device as claimed in claim 1, comprising at least two compression rollers with different diameters, which are fitted to rotate on a same support, with their axes parallel to one another, the support configured to pivot around an axis parallel to the axes of the two compression rollers to permit selection of one of the compression rollers for a winding operation.

* * * * *